US005542150A

United States Patent [19]

Tu

[11] Patent Number: 5,542,150

[45] Date of Patent: Aug. 6, 1996

[54] SIMPLE PUSH BUTTON TYPE LINK CONTROL STRUCTURE

[76] Inventor: A-Shih Tu, No. 61, Industry District, 32 Rd., Taichung, Taiwan

[21] Appl. No.: 297,768

[22] Filed: Aug. 30, 1994

[51] Int. Cl.[6] ..... A47B 95/02

[52] U.S. Cl. ..... 16/115; 280/655.1; 74/527

[58] Field of Search ..... 200/539, 520, 200/521, 538, 540, 341; 74/527, 538; 403/109, 329; 116/279; 190/18 R, 18 A, 115, 116; 280/655, 655.1, 47.315, 47.371; 16/115

[56] References Cited

U.S. PATENT DOCUMENTS

| | | | |
|---|---|---|---|
| 4,404,714 | 9/1983 | Duran | 403/328 |
| 4,616,952 | 10/1986 | Schott | 403/328 |
| 5,345,050 | 9/1994 | Branch et al. | 200/538 |
| 5,346,254 | 9/1994 | Budrow et al. | 280/655 |
| 5,394,594 | 3/1995 | Duran | 403/328 |
| 5,460,393 | 10/1995 | Tsai | 280/47.315 |
| 5,469,602 | 11/1995 | Lin | 16/115 |

*Primary Examiner*—David J. Walczak
*Attorney, Agent, or Firm*—Bacon & Thomas

[57] ABSTRACT

The present invention relates to a push button type pull rod control structure, i.e. to locate an adjustable length pull rod of a trunk. The control structure has a push button, a pull rod, a push rod, an outer rod, a sleeve, a control body, and a spring. A distal end of the pull rod has the sleeve, which includes an extensible control body. The control body, the push rod and it push button are connected to one another. Pushing the push button enables locating balls to move back into control body groove seat so as not to project into location holes of the outer rod to enable the length of the pull rod to be adjusted until the locating balls are aligned with other location holes on the outer rod. Releasing the push button enables the locating balls to project into other location holes, to hold the pull rod in its adjusted position.

1 Claim, 3 Drawing Sheets

SIMPLE PUSH BUTTON TYPE LINK CONTROL STRUCTURE

BACKGROUND OF THE INVENTION

The present invention relates to a control structure for locating a extensible link of a trunk, and particularly to a simple push button type link control structure that has a push button for the control of the link extension. The control structure is movable following the link. The whole structure is simple which results in easy manufacture and assembly.

The main objectives of the present invention are as follows: (1) a push button type operation to meet a user's habit and facility of use; (2) because the link must be extensible, control components of the control components of the multi-sectional type reduces the size of mold necessary for production and so assembly is easy; (3) the structure can be simplified to make production and assembly easy.

These and other objects and advantages of the present invention will become apparent to those skilled in the art after considering the following detailed specification together with the accompanying drawings.

DETAILED DESCRIPTION OF THE PREFERRED EMBODIMENT

Figure 1A:
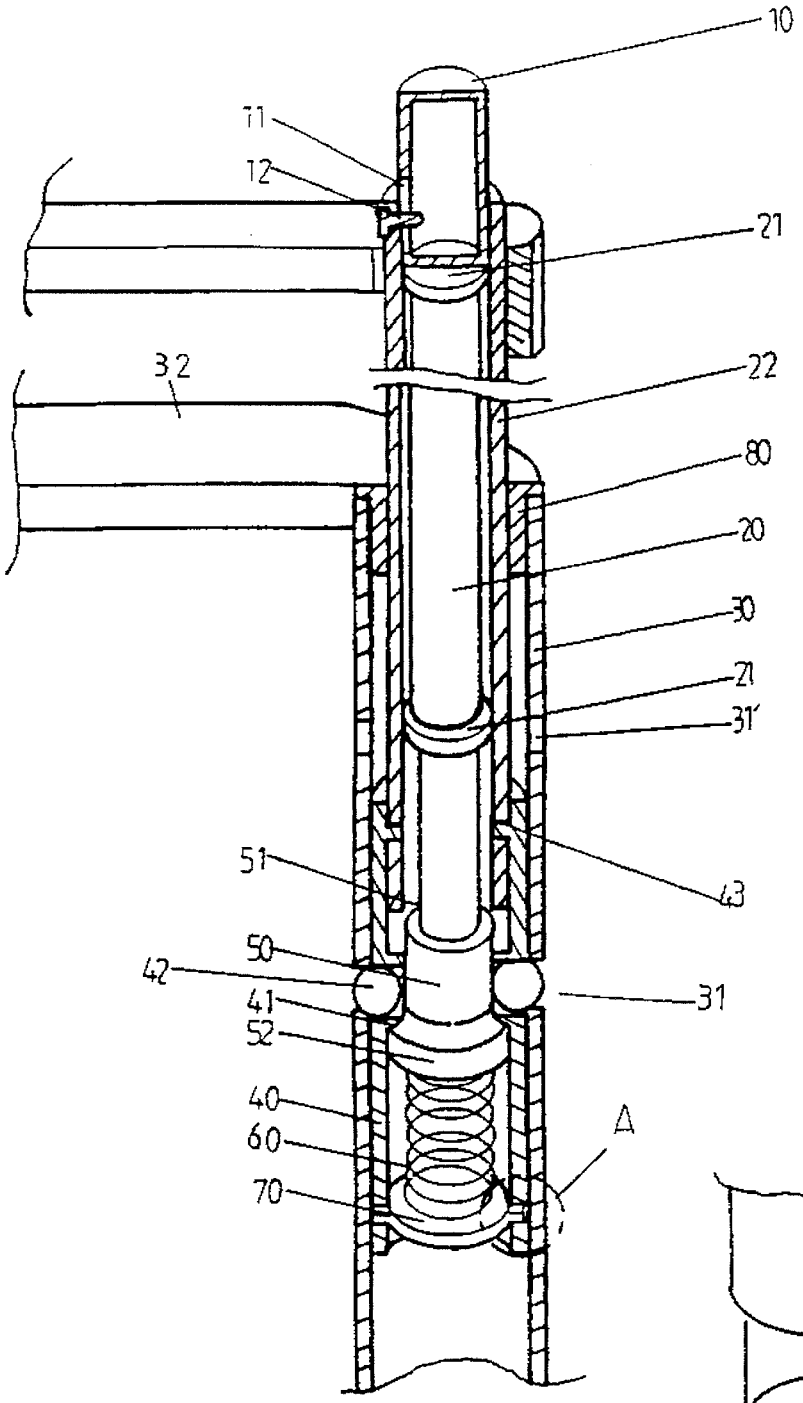
FIG. 1A is a cross-sectional-perspective view of the present invention.
Figure 1B:
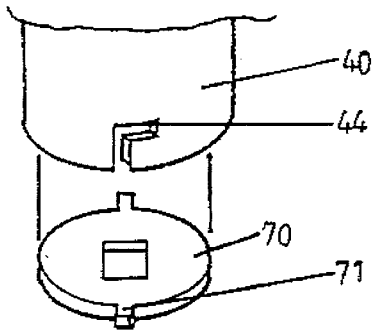
FIG. 1B is an enlarged perspective, exploded view of area A in FIG. 1A.

Referring to FIG. 1, the present invention comprises push button 10, pull rod 22, push rod 20, outer rod 30, sleeve 40, control body 50, and spring 60 wherein said push button 10 has a hollow body with an extension groove 11. Extension groove 11 is engaged by pin 12 to enable attachment of push button 10 with pull rod 22 so that push button 10 may slide up and down without risk of breaking away. Said outer rod 30 is fixed to a trunk 32 and has location holes 31 to locate the pull rod 22. Said sleeve 40 has "L" shaped retaining grooves 44 on the bottom, and a post 43 on an upper side. Groove seat 41 has through holes. Said control body 50 has flange 52 formed on a bottom, with recess 51 on an upper portion. Said push rod 20 forms a thrust rod with thrust plates 21 on both ends.

Referring to FIG. 1 again, push rod 20 with thrust plates 21 is inserted in the pull rod 22 in contact with push button 10. Groove seat 41 of sleeve 40 is mounted with locating ball 42 and is then placed on the control body 50, whereby the flange 52 of control body 50 is restricted by groove seat 41 without breaking away. The bottom of control body 50 has spring 60 engaged therewith which also contacts seal 70 located in "L" retaining grooves 44 of sleeve 40 by flange 71 for attachment with sleeve 40. Spring 60, control body 50 are assembled in sleeve 40, then sleeve 40 with post 43 may be attached with pull rod 22 and placed in outer rod 30. The top end of outer rod 30 has catch 80 for stopping the top end of sleeve 40 while preventing pull rod 22 from breaking away from outer rod 30.

Figure 2A:
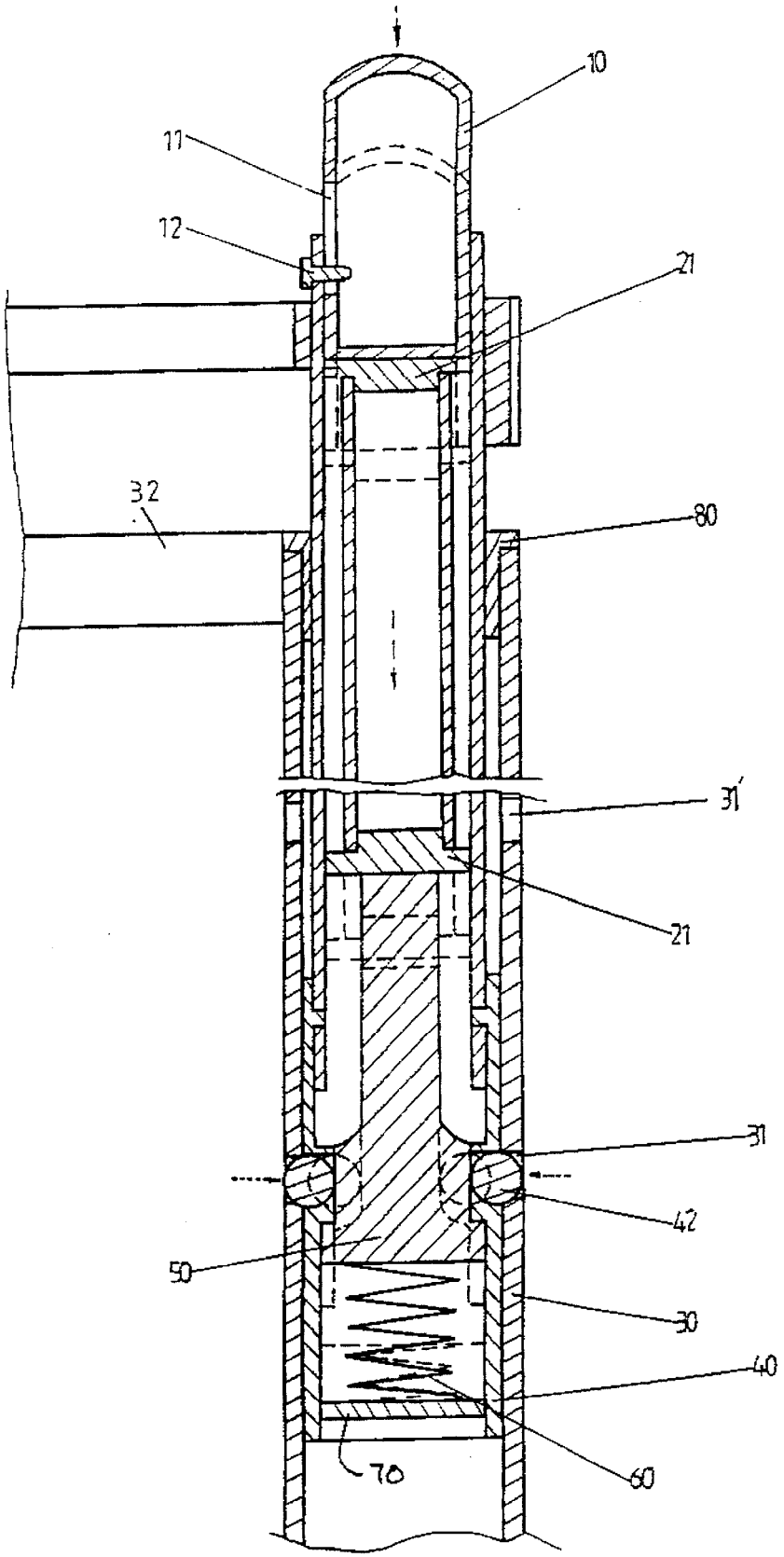
FIG. 2A is a cross-sectional view of the push button link control of the present invention.

The operation of the present invention are as follows:

1. Pull rod 22 stationary location: when locating ball 42 is aligned with location hole 31 of outer rod 30 (FIG. 2A), because of resilience of spring 60, the control body 50 is biased to an upward position, i.e. control body 50 shall push locating ball 42 to enable locating ball 42 to project into location hole 31 of outer rod 30 so that pull rod 22 will be prevented from moving.

Figure 2B:
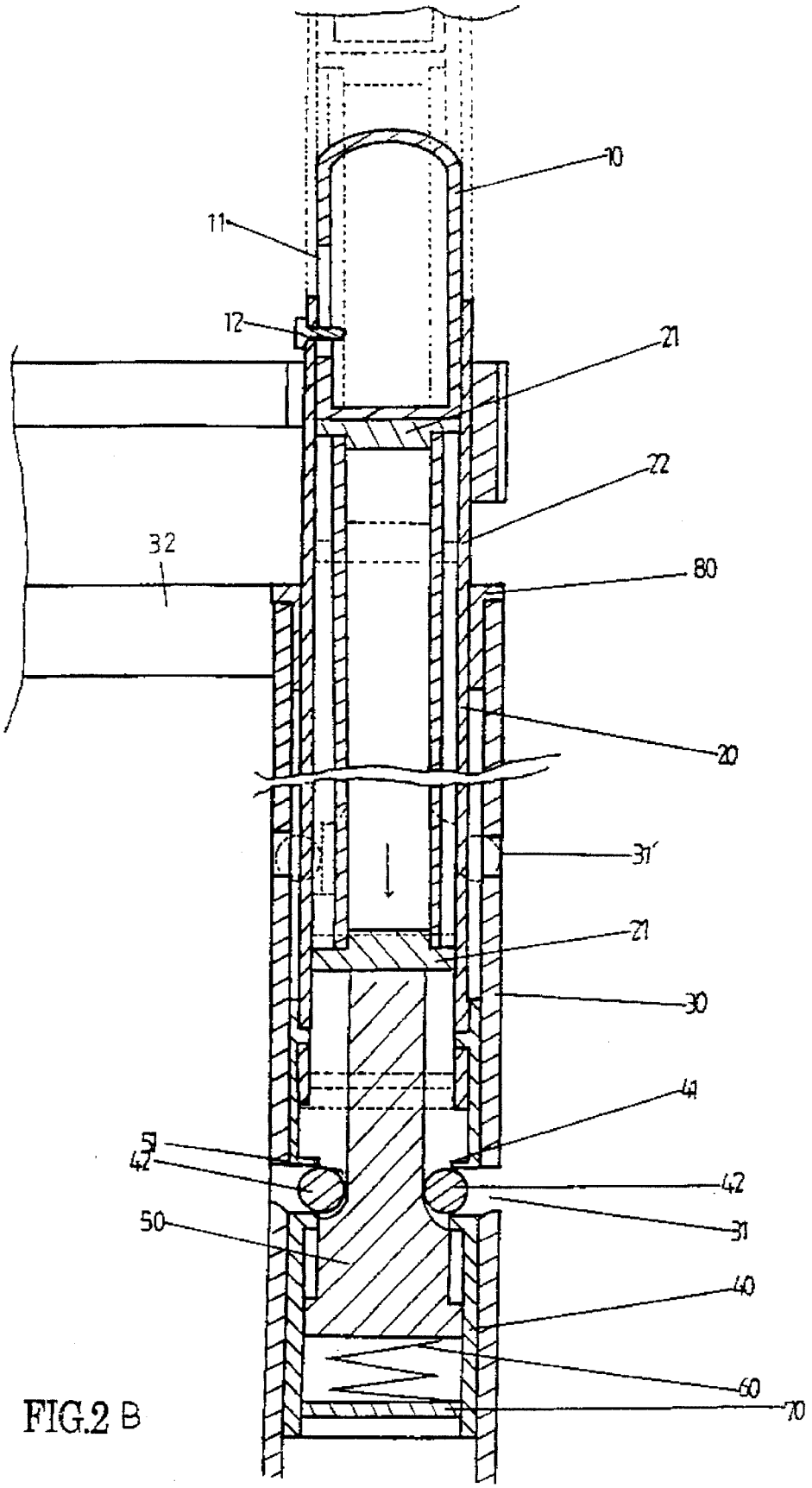
FIG. 2B is a cross-sectional diagrammatic view of the extensible action of a link having the push bottom control of the present invention.

2. Pull rod 22 adjustment: when pull rod 22 is intended for position adjustment (such as contracting or extending), as shown in FIG. 2B, pressing push button 10 pushes the push rod 20, which will further push control body 50 to enable control body 50 to descend within sleeve 40. Because of control body 50 having recess 51, locating balls 42 will no longer be pushed into holes 31 by control body 50, so the user may easily pull the pull rod 22 until balls 41 are aligned with location hole 31' of outer rod 30. Upon release of push button 10 locating ball 42 will project into location hole 31' as a result of spring 60 biasing control body 50 to hold pull rod 22 in position. The control of the present structure enables pull rod 22 to be adjusted without risk of malfunction due to careless use.

I claim:

1. A push button pull rod control structure for a trunk comprising: a push button, a pull rod, a push rod, an outer rod, a sleeve, a control body, and a spring wherein said push button has a hollow body with an extension groove engaged by a pin extending from a top end of the pull rod to connect the push button to the pull rod so that the push button may slide up and down without being removed from the pull rod;

said outer rod adapted to be attached to the trunk, and having a plurality of location holes located along a length thereof;

said sleeve being slidably positioned within said outer rod and having "L" shaped retaining grooves on a bottom portion, a post extending from an upper side thereof for connecting the sleeve to the pull rod, and a through hole having a groove seat thereon;

said control body slidably positioned within said sleeve and having a flange formed on a bottom portion thereof, and a recessed upper portion;

said push rod slidably positioned within said pull rod and having thrust plates on opposite ends thereof in contact with the push button and the control body, respectively;

at least one locating ball in the groove seat of said sleeve; said spring positioned between a seal positioned in said L-shaped retaining grooves and a lower end of said control body, said spring acting on the control body to bias the control body into contact with the thrust plate of the push rod whereby the flange of the control body urges the at least one locating ball into a first location hole and whereby movement of the push button against the spring bias aligns the recessed portion of the control body with the at least one locating ball enabling the retraction of the at least one locating ball from said first location hole, thereby enabling movement of the push button, pull rod, push roll, control body at least one locating ball and spring relative to the outer rod such that the at least one locating ball is moved from the first location hole to another location hole.

* * * * *